US006488579B2

(12) United States Patent
Larson et al.

(10) Patent No.: US 6,488,579 B2
(45) Date of Patent: Dec. 3, 2002

(54) VENTILATING EXHAUST FAN

(75) Inventors: David M. Larson, Hartford, WI (US); Robert G. Penlesky, Waukesha, WI (US); Daniel L. Karst, Beaver Dam, WI (US); Robert A. Chvosta, Hubertus, WI (US); Alan G. Klug, Mequon, WI (US); Kevin P. Gahagan, Colgate, WI (US)

(73) Assignee: Broan-Nutone LLC, Hartford, WI (US)

( * ) Notice: Subject to any disclaimer, the term of this patent is extended or adjusted under 35 U.S.C. 154(b) by 0 days.

(21) Appl. No.: 09/907,134

(22) Filed: Jul. 17, 2001

(65) Prior Publication Data

US 2001/0049260 A1 Dec. 6, 2001

Related U.S. Application Data

(63) Continuation of application No. 09/465,252, filed on Dec. 18, 1999, now Pat. No. 6,261,175.

(51) Int. Cl.[7] ..... F24F 7/007
(52) U.S. Cl. ..... 454/354; 415/204
(58) Field of Search ..... 454/354, 355; 415/204, 212.1

(56) References Cited

U.S. PATENT DOCUMENTS

| | | | | |
|---|---|---|---|---|
| 2,710,573 A | | 6/1955 | Marker | |
| 2,780,981 A | | 2/1957 | Miller | |
| 3,606,593 A | | 9/1971 | Steiner | |
| 3,926,537 A | | 12/1975 | James | |
| 4,073,597 A | | 2/1978 | Barnhart | |
| 4,510,851 A | | 4/1985 | Sarnosky et al. | |
| 4,594,940 A | | 6/1986 | Wolbrink et al. | |
| 4,610,705 A | | 9/1986 | Sarnosky et al. | |
| 4,628,802 A | | 12/1986 | Steiner et al. | |
| 4,867,640 A | * | 9/1989 | Penlesky et al. | 415/204 |
| 5,879,232 A | * | 3/1999 | Luter et al. | 454/349 |
| 6,027,406 A | * | 2/2000 | Yazici | 181/224 |

* cited by examiner

*Primary Examiner*—Derek S. Boles
(74) *Attorney, Agent, or Firm*—Michael Best & Friedrich LLP

(57) ABSTRACT

An exhaust fan for use in bathrooms or similar areas has a generally rectangular fan housing formed from two independent structural members to reduce manufacturing waste and decrease production cost. The fan housing includes a receptacle panel that can be installed and removed from within the housing without additional tools. The fan housing includes two series of spaced view holes formed in its back wall such that during installation of the exhaust fan, the installer can view the ceiling joist to correctly position the fan housing relative to the bottom surface of the joist. The back wall of the fan housing also includes a pair of bend down tabs that can be placed in contact with the bottom surface of the joist to correctly position the bottom edge of the fan housing the required distance from the joist to accommodate the most common drywall thickness. The fan wheel contained within the fan housing includes a mounting hub having an expanded diameter insertion portion formed on its central bore to receive drive shaft of driving motor of the exhaust fan.

25 Claims, 5 Drawing Sheets

FIG. 12
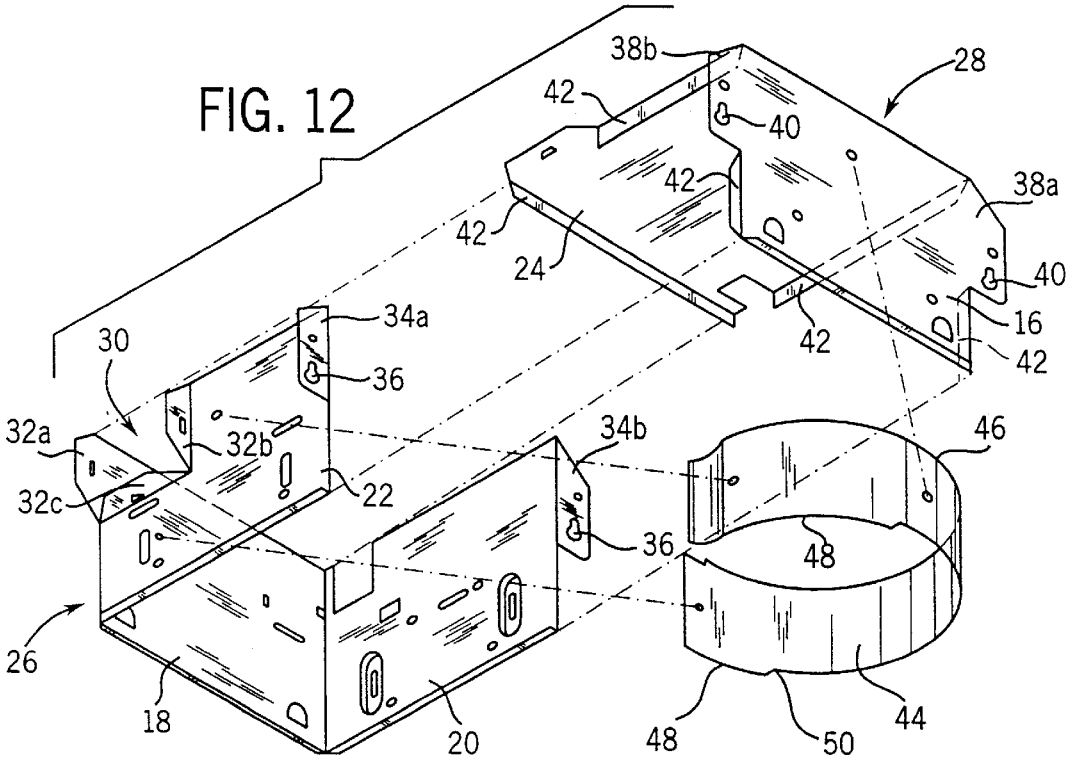
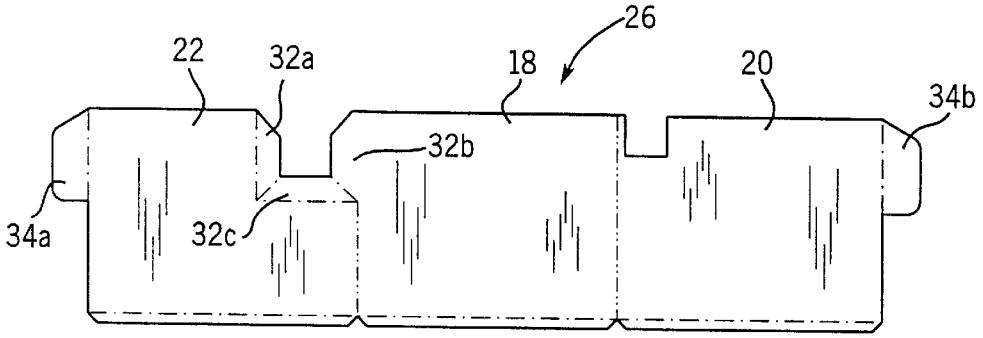
FIG. 12 (a)
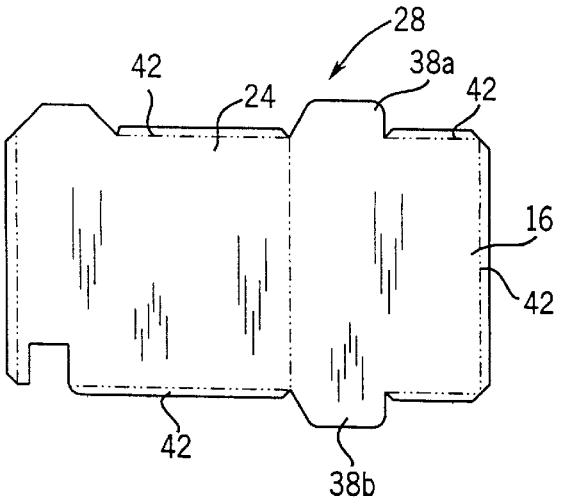
FIG. 12 (b)

VENTILATING EXHAUST FAN

This is a continuation of Ser. No. 09/465,252 filed Dec. 18, 1999 now U.S. Pat. No. 6,261,175.

BACKGROUND OF THE INVENTION

The present invention generally relates to a centrifugal ventilating exhaust fan, such as those typically utilized in bathrooms and other enclosed living spaces. More specifically, the present invention is a ventilating exhaust fan that includes an improved receptacle mounting panel, improved mounting alignment aids and an improved two-piece construction.

Ventilating exhaust fans, such as those typically included in bathrooms, draw air from within the enclosed area and pass the exhausted air out a vent in the gable or roof of the home. Ventilation is thus provided for the enclosed living space. Centrifugal exhaust fans include a rotating fan wheel having a plurality of vanes that create an outward airflow which, in turn, is directed out of an outlet opening by a curved fan scroll surrounding the fan wheel Typical exhaust fans currently in use include a box-like housing positioned above a hole cut in the ceiling and are fastened to one of the ceiling joists. The fan wheel is typically directly coupled to a driving motor that is supported within the fan housing. A number of problems exist in such ventilating exhaust fans. Some of these problems arise during the installation of the fan to the ceiling joist. Since the ventilating exhaust fan is installed in new home constructions before the finishing drywall is put in place, the fan housing must be properly positioned along the ceiling joist to create the required spacing between the lower edge of the fan housing and the ceiling joist such that the drywall sheets properly abut against the edge of the ventilating exhaust fan.

In addition, the ventilating exhaust fan is typically connected to a supply of electricity to power the electric driving motor and possibly a lighting assembly associated with the exhaust fan. During installation, the supply of electricity must be fed into the enclosed fan housing and coupled to the wiring of the exhaust fan. Since the electric wiring of the exhaust fan is typically fixed within the fan housing, wiring of the ventilating exhaust fan during installation often proves to be cumbersome.

Therefore, it is an object of the present invention to provide a ventilating exhaust fan for bathrooms and other similar locations that includes a removable receptacle panel that can be removed from the fan housing to allow the exhaust fan to be connected to the electrical wiring of the home outside of the fan housing. Once the exhaust fan has been properly wired, the receptacle panel can be repositioned within the fan housing. It is a further object of the present invention to provide a fan housing that includes a series of vertically spaced view holes along the back wall of the fan housing to aid in the vertical alignment of the fan housing along the ceiling joist. Further, it is an object of the present invention to provide a pair of bend down tabs on the back wall of the fan housing to aid in vertically aligning the fan housing when the home in which the fan is being installed includes a common thickness of drywall. Further, it is an object of the present invention to provide a fan wheel that includes a mounting hub having an expanded inner diameter insertion portion that aids in the initial positioning of the fan wheel on the drive shaft of the electric driving motor. Finally, it is an object of the present invention to provide a fan housing formed from two pieces of bent, sheet-like material such that the fan housing can be constructed in a cost efficient manner.

Various other features, objects and advantages of the invention will be made apparent from the following description taken together with the drawings.

SUMMARY OF THE INVENTION

The exhaust fan of the present invention includes a generally rectangular fan housing with a base wall. When the exhaust fan is installed on a joist above the ceiling of a bathroom or similar enclosed area, the base wall forms the top of the housing. Two sidewalls, a front wall and a back wall depend from the base wall to define the generally rectangular fan housing. A fan scroll is positioned within the fan housing and is in contact with the base wall to form a centrifugal path leading to an exhaust opening formed in one of the sidewalls. The exhaust opening includes an outlet fitting to direct the flow of exhausted air from the bathroom or similar enclosed area.

The fan housing of the present invention is formed from a first structural member and a second structural member joined to each other. The first structural member is formed from a sheet of stamped material that is bent to form the front wall and a pair of sidewalls. The second structural member is also a sheet of stamped material that is bent to form the base wall and the back wall. The first structural member includes a pair of mounting flanges that align with a corresponding pair of mounting flanges formed on the second structural member when the first and second structural members are joined to form the fan housing. The double thickness of the material created by the overlapping mounting flaps increases the material thickness of the fan housing in the area where the fan housing is attached to the ceiling joist.

To enhance the ease of the electrical connection between the exhaust fan of the present invention and the electrical power supply within the home, the exhaust fan includes a removable receptacle panel that can be removed from the fan housing, connected to the electrical wiring and reinstalled within the fan housing after the wiring connections have been made. The receptacle panel includes a first locking tab that engages a slot formed in the front wall of the fan housing. A second locking tab formed on the base plate of the receptacle panel is received behind a retaining clip formed on one sidewall of the fan housing to secure the receptacle panel in its installed position.

The receptacle panel further includes a removal tab that can be grasped by the user to pull the receptacle panel from its frictional interaction with the retaining clip. In this manner, the receptacle panel can be easily installed and removed from within the fan housing without any tools.

In accordance with another aspect of the invention, the fan wheel includes a central mounting hub having a central bore whose internal diameter corresponds to the outer diameter of the motor shaft. The mounting hub further includes an insertion portion formed along the central bore near the outer end of the mounting hub. The insertion portion has an increased inner diameter such that the inner diameter of the insertion portion is slightly larger than the outer diameter of the drive shaft to facilitate the initial application of the fan wheel to the drive shaft.

The fan scroll mounted to the base wall of the fan housing includes a pre-load notch having a reduced height relative to the remaining portions of the fan scroll. The reduced height pre-load notch allows the installed motor support plate to pivot slightly within the fan housing and permit removal of the motor support plate from within the four walls defining the fan housing.

In yet another aspect of the invention, the back wall of the fan housing includes two series of view holes. Each series of view holes is positioned adjacent to a side edge of the back wall of the fan housing. The view holes of each series are vertically spaced from each other such that the view holes can be aligned with the bottom edge of a ceiling joist to provide the required spacing between the bottom edge of the ceiling joist and the bottom edge surface of the fan housing to accommodate the most common thicknesses of drywall.

In an additional feature of the invention, the back wall of the fan housing includes a pair of bend down tabs that can be bent to a horizontal position. When the bend down tabs are in their horizontal position, the bend down tabs can be placed in contact with the bottom edge of the ceiling joist to provide the required spacing between the ceiling joist and the bottom-most edge of the fan housing to accommodate the most popular thickness of drywall.

BRIEF DESCRIPTION OF THE DRAWINGS

The drawings illustrate the best mode presently contemplated of carrying out the invention.

In the drawings:

FIG. 12 is an exploded perspective view illustrating the two-piece construction of the fan housing;

FIG. 12*a* is a front view illustrating the stamped sheet of material used to form the first structural member that defines the fan housing; and FIG. 12*b* is a front view of the second structural member used to define the fan housing.

DETAILED DESCRIPTION OF THE INVENTION

Figure 1:
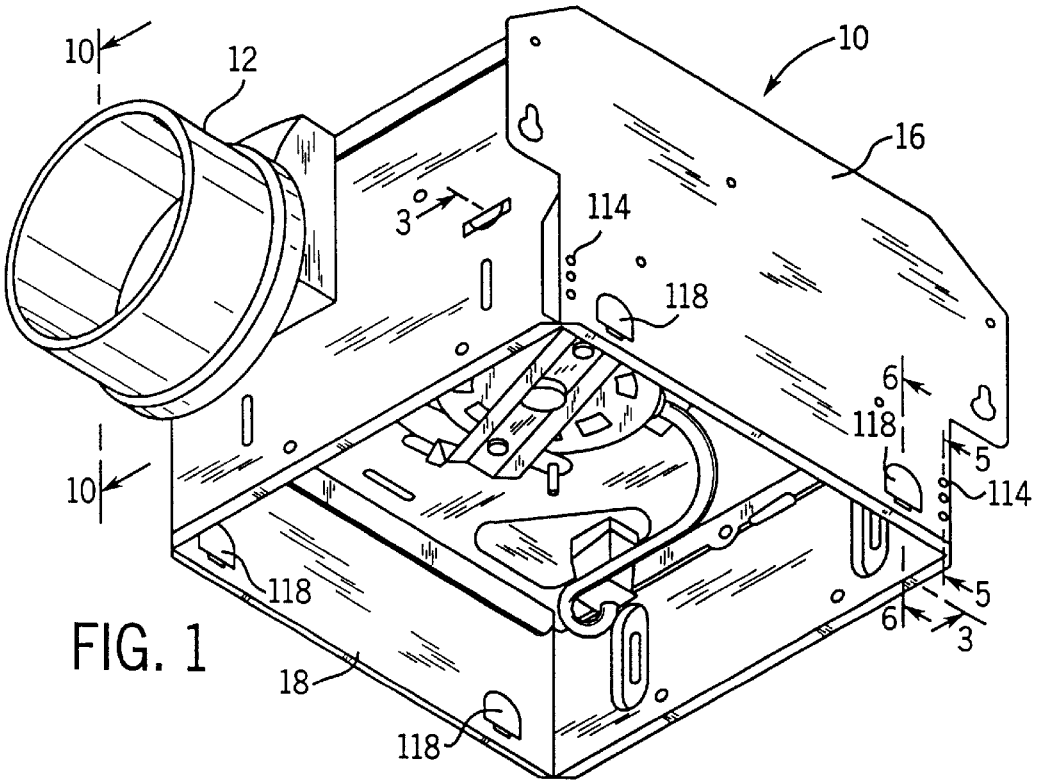
FIG. 1 is a perspective view of a ventilating exhaust fan of the present invention.

Referring first to FIG. 1, thereshown is a ventilating exhaust fan 10 of the present invention. The exhaust fan 10 is typically used in an enclosed room of a home, such as an exhaust fan in a bathroom. In use, the fan 10 can be conveniently mounted in either the horizontal or vertical position. Thus, the fan 10 is fastened along one side to a ceiling joist or sub-joist or to a wall stud. A louver (not shown) extends below the ceiling or beyond the wall of the bathroom or other space. The exhaust fan 10 operates to draw air in through vents in the louver and discharge the airflow through an outlet fitting 12. The outlet fitting 12 is connected to an exhaust duct that directs the airflow and discharges it out through a vent in the gable or roof of the home.

Figure 2:
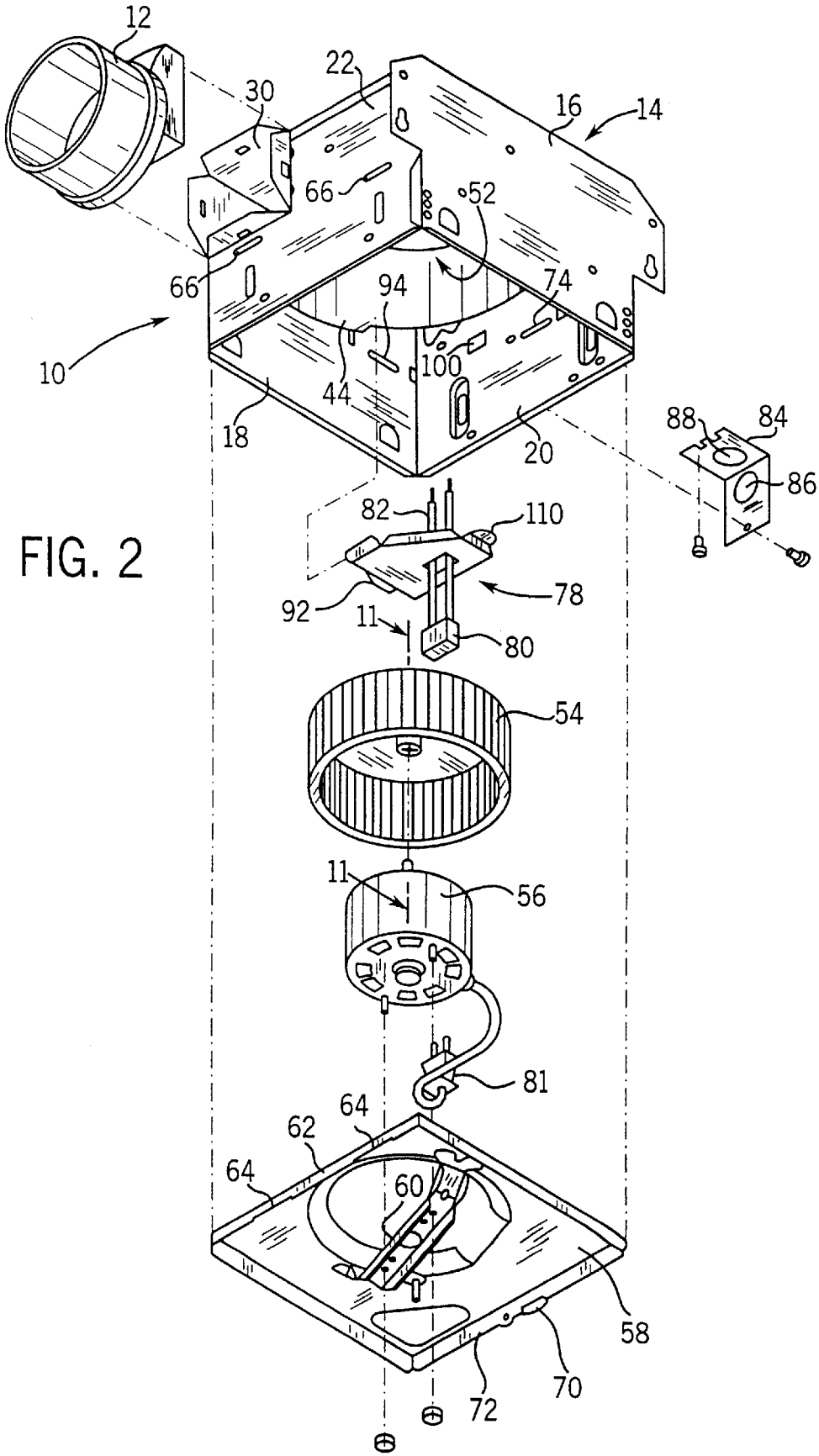
FIG. 2 is an exploded perspective view illustrating the internal components of the exhaust fan of the present invention.

Referring now to FIG. 2, the exhaust fan 10 includes a fan housing 14 formed from sheet metal or other suitable material of a thickness sufficient to provide the necessary structural strength for the exhaust fan 10. The fan housing 14 includes a back wall 16, a front wall 18, and a pair of sidewalls 20 and 22. The back wall 16, front wall 18 and sidewalls 20 and 22 are joined to form a generally rectangular enclosure having an open bottom end and a top end closed by a base wall 24, as best shown in FIG. 12.

As illustrated in FIGS. 12, 12*a* and 12*b*, the fan housing 14 is a two-piece construction formed from a first structural member 26 and a second structural member 28. The first structural member 26 is a flat sheet of material, such as galvanized steel, that is bent into the configuration shown in FIG. 12 to define the front wall 18 and the pair of sidewalls 20 and 22. In addition, the first structural member 26 defines an outlet opening 30 having three extending outlet flanges 32*a*–32*c*.

The first structural member 26 includes a first pair of mounting flanges 34*a* and 34*b* that each extend perpendicular to one of the sidewalls 20 and 22. As can be understood in FIGS. 12 and 12*a*,each of the mounting flanges 34*a* and 34*b* are bent at an angle of 90° relative to the respective sidewall 20, 22 to which it is attached. Each mounting flange 34*a*, 34*b* includes an attachment hole 36 through which a support member, such as a screw, passes to support the fan housing 14 on the ceiling joist.

Referring now to FIGS. 12 and 12*b*, the second structural member 28 is a flat sheet of material, such as galvanized steel, that is bent to define both the back wall 16 and the base wall 24. The second structural member 28 includes a second pair of mounting flanges 38*a* and 38*b* that each extend directly from the back wall 16 and each include an attachment hole 40. When the first structural member 26 and the second structural member 28 are joined to each other, the first pair of mounting flanges 34*a* and 34*b* are aligned with the second pair of mounting flanges 38*a* and 38*b* such that the material thickness is doubled in the area of the fan housing 14 that supports the fan housing on the ceiling joist. The second structural member 28 includes peripheral edge tabs 42 that are bent over and used to join the first structural member 26 to the second structural member 28 in a conventional manner.

In the embodiment of the invention illustrated, both the first structural member 26 and the second structural member 28 are stamped from sheets of galvanized steel, which produces only small amounts of scrap. In both the first and second structural members, the mounting flanges are formed from the continuous sheet of material, such that the mounting flanges do not need to be attached to the fan housing 14 after the fan housing has been assembled. In prior fan housings for similar exhaust fans, the mounting flanges are either attached to the fan housing in a separate step or each of the sidewalls 20 and 22, as well as the back wall 16, are formed from separate sheets of material to create the double thickness of material in the mounting flanges. By utilizing the two-piece construction of the present invention, significant material and labor costs can be saved during construction of the fan housing 14.

As can be understood in FIG. 12, the fan housing 14 is formed from two individual pieces of material that are each bent to desired configuration and joined to each other. Most importantly, the two-piece configuration for the fan housing 14 provides for a double material thickness in the area of the fan housing that supports the weight of both the fan housing 14 and the internal operating components.

Referring now to FIG. 2, the fan housing 14 generally defines an open interior that includes a curved sheet of metallic material that defines a centrifugal fan scroll 44. As can be seen in FIG. 12, top edge surface 46 of the fan scroll 44 contacts the inner surface of the base wall 24. Fan scroll 44 is secured to the sidewall 22, back wall 16 and the front wall 18. The fan scroll 44 includes a bottom edge surface 48 that includes a reduced height pre-load notch 50, the significance of which will be discussed in greater detail below. The fan scroll 44 defines a fan wheel chamber 52 that is sized to receive a fan wheel 54, as best illustrated in FIG. 2. The fan wheel 54 includes a plurality of individual vanes that create a centrifugal flow of air when the fan wheel 54 rotates. The fan wheel 54 is mounted to a driving motor 56 that is operable to rotate the fan wheel to create a flow of air out of the outlet opening 30 and through the outlet fitting 12. The motor 56 is supported within the fan wheel chamber 52 by a motor support plate 58 and an attached motor mounting bracket 60.

Figure 3:
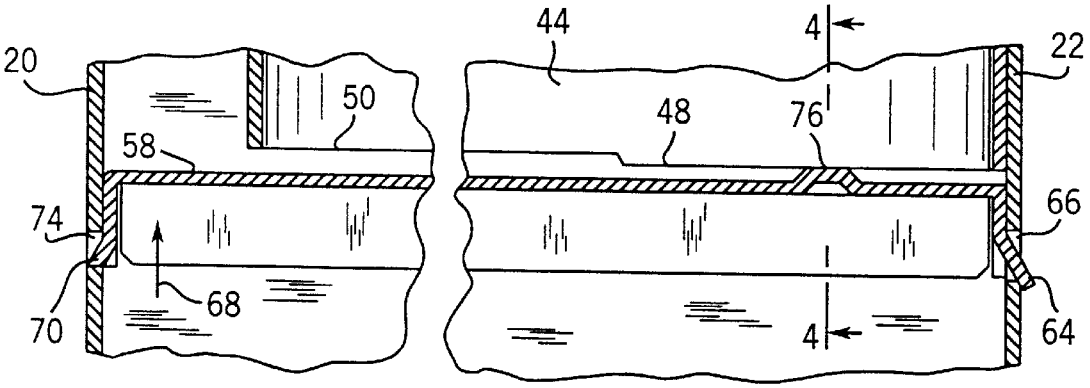
FIG. 3 is a partial section view taken along line 3—3 of FIG. 1 illustrating the interaction between the motor support plate and the fan scroll of the exhaust fan.
Figure 4:
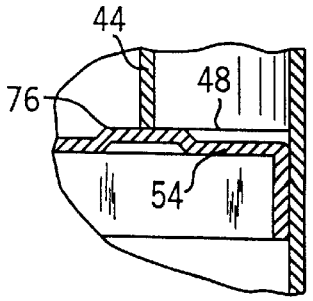
FIG. 4 is a partial section view taken along line 4—4 of FIG. 3 further illustrating the interaction between a detent formed on the motor support plate and the fan scroll.

Referring now to FIGS. 2 and 3, the motor support plate 58 includes a first peripheral edge flange 62 having a pair of tabs 64 that extend completely through corresponding slots 66 formed in the sidewall 22 of the fan housing 14. The interaction between the pair of tabs 64 formed on the motor support plate 58 and the slots 66 formed in the sidewall 22 aid in holding the motor support plate 58 within the fan housing 14 against the force of gravity.

Once the pair of tabs 64 have been inserted into the slots 66 in the sidewall 22, the opposite edge of the motor support plate 58 can be pushed upward, as illustrated by arrow 68, until an angled tab 70 formed on a second peripheral edge flange 72 engages a slot 74 formed in the sidewall 20. When the angled tab 70 is received within the slot 74, the motor support plate 58 is securely held within the open interior of the fan housing 14 between the rectangular sidewalls 20 and 22.

When the motor support plate 58 is installed within the fan housing 14, as best illustrated in FIG. 3, a detent 76 stamped into the motor support plate 58 contacts the bottom edge surface 48 of the fan scroll 44. The detent 76 spaces the remaining portions of the motor support plate 58 slightly above the bottom edge surface 48 of the fan scroll 44. The pre-load notch 50 formed on the fan scroll 44 creates a larger physical separation between the motor support plate 58 and the fan scroll 44 in that area, which allows the motor support plate 58 to move slightly upward, as illustrated by arrow 68, such that the angled tab 70 can be removed from slot 74 to permit the motor support plate 58 to be removed from within fan housing 14. Without the decreased height of the fan scroll 44 along the area identified by the pre-load notch 50, removal of the motor support plate 58 would be much more difficult due to the nearly identical dimensions of the fan housing 14 and the motor support plate 58.

Referring back to FIG. 2, the exhaust fan 10 includes a receptacle panel 78 that supports at least one electrical receptacle 80 within the fan housing 14. In the embodiment of the invention illustrated, the single electrical receptacle 80 receives the plug 81 of the motor 56. An additional electrical receptacle 80 could also be supported by the receptacle panel 78 to provide power for an optional lighting assembly (not shown). Electrical receptacle 80 includes a pair of wires 82 that are connected to the supply of electricity for the home in which the exhaust fan 10 is installed to provide power for the fan. In accordance with the present invention, the receptacle panel 78 is removably mounted within the fan housing 14 and can be removed and installed without the aid of any tools. The wires 82 are field-connected to power source wires that pass through a wire plate 84 connected to both the base wall 24 and the sidewall 20. The wire plate 84 includes a horizontal access hole 86 and a vertical access hole 88 to permit the power source wires to pass through either the base wall 24 or the sidewall 20. The vertical access hole 88 is shown in the preferred embodiment of the invention as including a knockout that can be removed if vertical wiring access is required. The wire plate 84 can be removed from the fan housing 14 to provide unlimited wiring access from the outside of the fan housing 14. The wire plate 84 can be reverse-mounted to the fan housing 14 to permit the power source wires to pass through either the base wall 24 or the sidewall 20 without removing the knockout.

Figure 9:
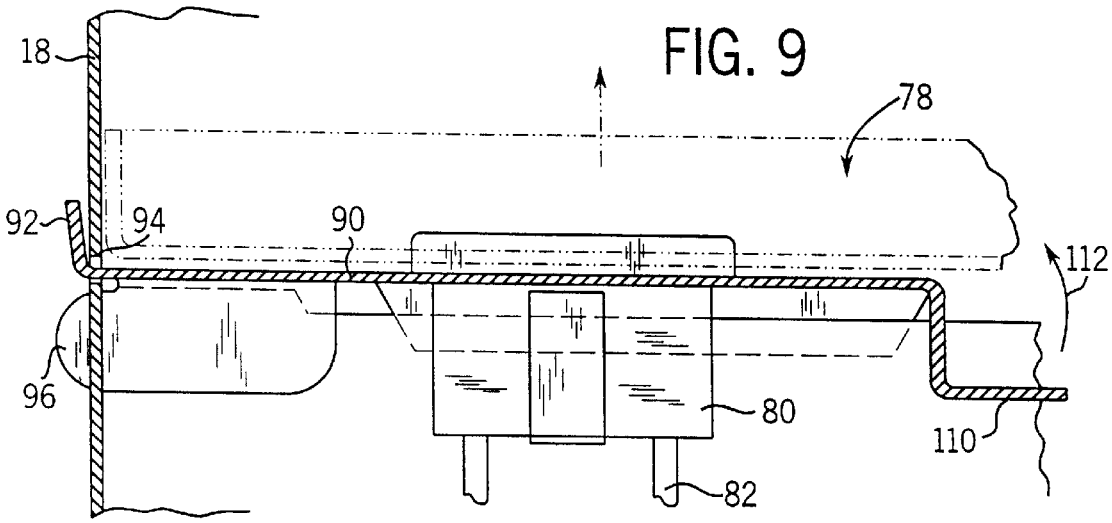
FIG. 9 is a section view taken along line 9—9 of FIG. 7 further illustrating the mounting of the receptacle panel within the fan housing.

Referring now to FIG. 9, the receptacle panel 78 generally includes a horizontal base plate 90 and a first locking tab 92 that extends vertically from the base plate 90. Locking tab 92 extends through a mounting slot 94 formed in the front wall 18 to aid in holding the receptacle panel 78 in contact with the front wall 18. Additionally, a pair of ears 96 extend vertically from the base plate 90 and pass through corresponding slots in the front wall 18 to aid in holding the receptacle panel 78 in place.

After the locking tab 92 and ears 96 are positioned in the corresponding slots in the front wall 18, a locking flange 98 extending vertically from the base plate 90 is pressed behind a retaining clip 100 formed as part of the sidewall 20. The retaining clip 100 includes a curved portion 102 that is received within an open notch 104 formed in the locking flange 98 such that the retaining clip 100 retains the receptacle panel 78 in the position shown.

Figure 8:
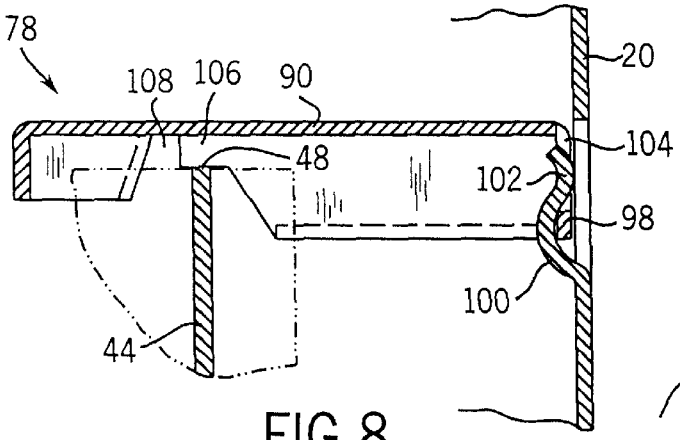
FIG. 8 is a section view taken along line 8—8 of FIG. 7 illustrating the mounting of the receptacle panel within the fan housing.

When the receptacle panel 78 is pressed into its installed position as shown in FIG. 8, a spacer tab 106 protruding from the base plate 90 contacts the bottom edge surface 48 of the fan scroll 44 to create an opening 108 between the base plate 90 and the fan scroll 44. The opening 108 provides adequate spacing between the base plate 90 and the fan scroll 44 to allow a wire 82 of the receptacle 80 to pass between the top edge 48 of the fan scroll 44 and the base plate 90. The spacing between the base plate 90 and the fan scroll 44 prevents inadvertent severing of the wire 82 during installation of the receptacle panel 78.

Figure 7:
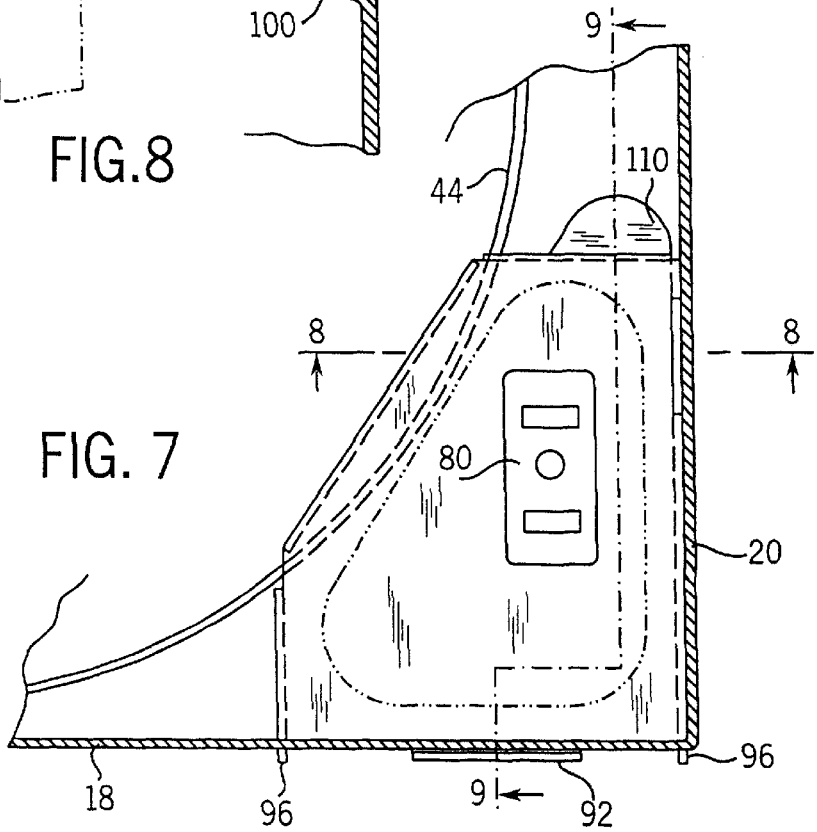
FIG. 7 is a partial top plan view illustrating a receptacle panel installed within the fan housing.

Referring now to FIGS. 7 and 9, the receptacle panel 78 further includes a horizontal removal tab 110 that can be grasped by the user to pull the receptacle panel 78 from its installed position. Specifically, the removal tab 110 is positioned between the fan scroll 44 and the sidewall 20 and can be grasped by the user to pull the receptacle panel 78 out of the fan housing 14, as illustrated by arrow 112, against the frictional interaction formed between the retaining clip 100 and the locking flange 98.

The removable receptacle panel 78 of the present invention allows a builder or electrician installing the exhaust fan 10 to connect the wires 82 to the supply of electricity for the house outside of the fan housing 14. Once the wires 82 have been connected to the supply of electricity for the home, the wires 82 can be pulled through the fan housing 14 and the receptacle panel 78 installed within the fan housing 14 as previously described.

Figure 5:
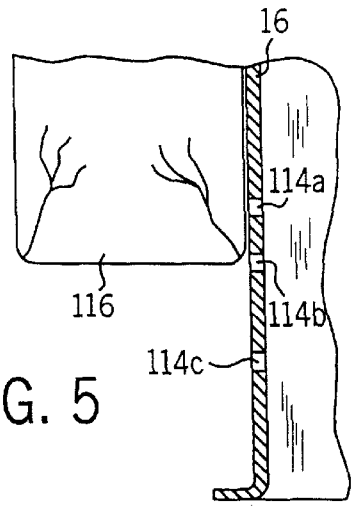
FIG. 5 is a section view taken along line 5—5 of FIG. 1 illustrating the view holes formed in the back wall of the fan housing as used to aid in the vertical alignment of the fan housing along the ceiling joist.

Referring now to FIGS. 1 and 5, the back wall 16 of the fan housing 14 includes two series of vertically spaced view holes 114. The view holes 114 allow the installer of the exhaust fan 10 to look through the back wall 16 and the open interior defined by the fan housing 14 and view the position of the ceiling joist 116 relative to the fan housing 14. The view holes 114 are spaced from each other by set distances to accommodate common thickness of drywall. For example, the uppermost hole 114*a* shown in FIG. 5 can be aligned with the bottom of the joist 116 when drywall having a thickness of 1 ¼ inches is utilized. The middle hole 114*b* corresponds to one inch thick drywall, while the bottom hole 114*c* is spaced for use with ⅝ inch thick drywall. In the preferred embodiment of the invention, an indicia corresponding to the drywall thickness for the individual view hole 114 is stamped into the back wall 16 immediately next to the view hole 114.

In the past, the installer of an exhaust fan had to measure the distance from the bottom edge of the fan housing 14 to the bottom of the joist in order to determine the proper placement of the fan housing. By utilizing the two spaced series of view holes 114, the installer or electrician can not only correctly space the bottom edge of the fan housing from the bottom of the ceiling joist, but also ensure that the fan housing 14 is level by properly aligning the two series of view holes 114.

Figure 6:
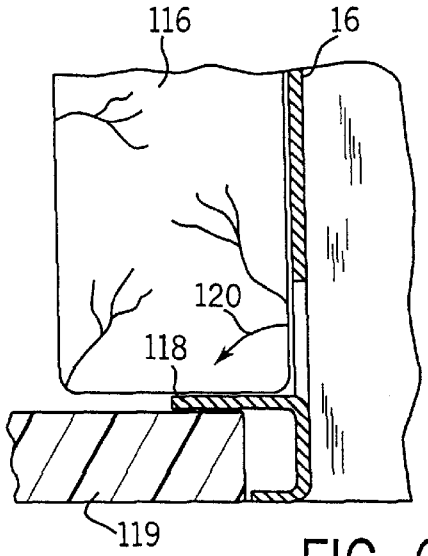
FIG. 6 is a section view taken along line 6—6 of FIG. 1 illustrating one of the bend down tabs used to vertically align the fan housing along the ceiling joist.

Referring now to FIGS. 1 and 6, the back wall 16 further includes a pair of bend down tabs 118 that can be moved from the generally vertical, storage position shown in FIG. 1 to a horizontal, operating position shown in FIG. 6. When the bend down tabs 118 are in the horizontal, operating position, the tabs 118 can be pressed against the bottom edge of the ceiling joist 116 to provide the required spacing for ½ inch thick drywall 119, which is the most common drywall used in newly constructed homes. Thus, if the installer or builder knows that ½ inch thick drywall is going to be used in the bathroom in which the exhaust fan 10 is installed, the installer can press the bend down tabs 118 into their horizontal position, as indicated by arrow 120, and place the bend down tabs 118 in contact with the bottom edge surface of the ceiling joist 116, thus quickly and accurately positioning the fan housing 14 on the ceiling joists 116. In addition to being contained on the back wall 116, a pair of similar bend down tabs 118 can also be formed in the front wall 18 of the fan housing 14, as illustrated in FIG. 1. In this manner, the two pair of bend down tabs 118 can be used to level and support the fan housing 14 between adjacent ceiling joists 116.

Figure 10:
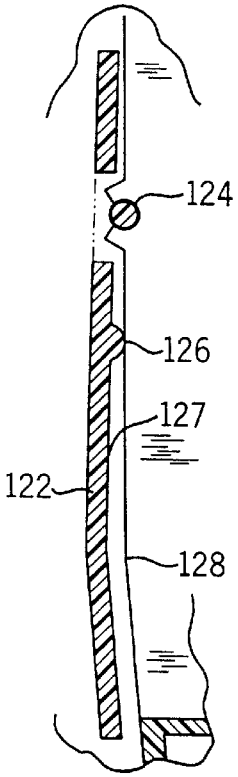
FIG. 10 is a section view taken along line 10—10 of FIG. 1 illustrating the construction of the exhaust flap positioned adjacent to the exhaust outlet of the fan housing.

Referring now to FIG. 10, the outlet fitting 12 includes a plastic damper flap 122 that pivots about a pivot pin 124 to open or block access to the outlet opening 30 formed in the fan housing 14. When the motor 56 and fan wheel 54 are rotating, airflow from the exhaust fan 10 forces the damper flap 122 to rotate outward in a clockwise direction to permit airflow to be vented to the outside of the home. However, when the motor 56 and fan wheel 54 are inactive, a back draft causes the damper flap 122 to rotate in the counterclockwise direction to prevent the back draft from entering into the bathroom or enclosed area in which the exhaust fan 10 is mounted.

In the preferred embodiment of the invention illustrated, a pair of stop pins 126 extend from the back face surface 127 of the damper flap 122 and contact a stop surface 128 formed in the outlet fitting 12. The stop pins 126 provide small points of contact with the stop surface 128 to reduce the amount of noise generated when the damper flap 122 is pressed against the stop surface 128 by a back draft. In previous embodiments of similar exhaust fans, entire damper flap 122 contacts the stop surface 128 and generates a perceptible amount of flapping noise.

Figure 11:
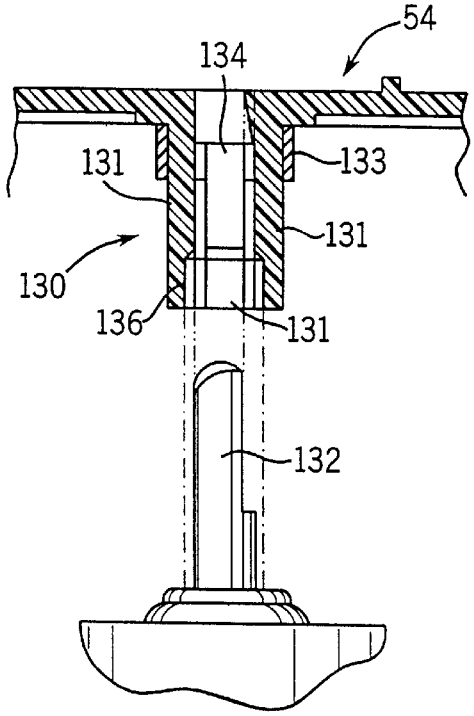
FIG. 11 is a section view taken along line 11—11 of FIG. 2 illustrating the mounting of the fan wheel onto the drive shaft of the driving motor.

Referring now to FIG. 11, the fan wheel 54 includes a central mounting hub 130 having independent fingers 131 that receives a drive shaft 132 of the driving motor 56. The mounting hub 130 includes a central bore 134 having an internal diameter approximately equal to the outer diameter of the drive shaft 132. A retaining band 133 surrounds the base of the independent fingers 131 to limit the outward flexing of the fingers 131. Thus, the mounting hub 130 is sized to receive the drive shaft 132 and retains the drive shaft 132 in the central bore 134 through a tight friction fit.

In accordance with the present invention, an insertion portion 136 is formed in the outer end of the mounting hub 130 to aid in insertion of the drive shaft 132 into the mounting hub 130. The insertion portion 136 is counterbored in the fingers 131 and has an inner diameter that is slightly greater than the inner diameter of the remaining portion of the central bore and thus slightly larger than the outer diameter of the drive shaft 132. In this manner, the drive shaft 132 can be easily inserted into the insertion portion 136 without any force being applied between the drive shaft 132 and the fan wheel 54. This feature is particularly important during assembly of the exhaust fan 10 since the fan wheel 54 is initially applied to the drive shaft 132 by a human assembly person during fabrication of the exhaust fan 10. After the human assembly person has placed the fan wheel 54 on the drive shaft 132, an automated machine presses the fan wheel 54 completely downward onto the drive shaft 132 to finally install the fan wheel 54 on the drive shaft 132. Without the insertion portion 136, the human assembly person would have a significantly more difficult time initially placing the fan wheel 54 on the drive shaft 132.

Various alternatives and embodiments are contemplated as being within the scope of the following claims particularly pointing out and distinctly claiming the subject matter regarded as the invention.

We claim:

1. A ventilating exhaust fan comprising:

a fan housing having a base wall and four sidewalls attached thereto;

a centrifugal fan scroll contained within the fan housing and extending from the base wall to define a fan wheel chamber in the fan housing;

an exhaust outlet formed in one of the sidewalls of the fan housing, the exhaust outlet being in communication with the fan wheel chamber formed by the fan scroll;

a receptacle panel including at least one electric receptacle, the receptacle panel pivotally coupled to the fan housing, the receptacle panel pivotable between an open and a closed position within the fan housing;

a fan wheel rotatably positioned within the fan wheel chamber; and a motor supported within the fan wheel chamber and coupled to the fan wheel, the motor being operable to rotate the fan wheel in the fan wheel chamber to direct a flow of air out of the exhaust outlet.

2. The ventilating exhaust fan of claim 1 wherein the receptacle panel includes a base plate, a first locking tab extending perpendicularly from the base plate, and a second locking tab extending perpendicularly from the base plate, wherein the first locking tab passes through a mating slot formed in one of the sidewalls of the fan housing and the second locking tab engages a retaining clip extending from the second sidewall of the fan housing when the receptacle panel is in the installed position.

3. The ventilating exhaust fan of claim 2 further comprising a spacer tab extending from the base plate, wherein the spacer tab engages the fan scroll to space the base plate below the fan scroll when the receptacle panel is in the installed position.

4. The ventilating exhaust fan of claim 2 wherein the receptacle panel further includes a removal tab extending from the base plate and positioned between the fan scroll and one of the sidewalls when the receptacle panel is in the installed position.

5. The ventilating exhaust fan of claim 1 wherein the fan wheel includes a mounting hub for attaching the fan wheel to a drive shaft of the motor, the mounting hub having a central bore having an internal diameter slightly smaller than the diameter of the drive shaft, the central bore further including an insertion portion having an internal diameter slightly larger than the diameter of the drive shaft such that when the fan wheel is initially applied to the drive shaft, the drive shaft is initially received in the insertion portion of the central bore.

6. The ventilating exhaust fan of claim 1 wherein the fan housing is formed from a sheet-like first structural member that is bent to define three of the sidewalls and a sheet-like second structural member that is bent to define the fourth sidewall and the base wall, the first and second structural members being joined to each other to define the fan housing.

7. The ventilating exhaust fan of claim 6 wherein the first structural member includes a pair of mounting flanges formed on opposite sidewalls and the second structural member includes a second pair of mounting flanges formed on opposite sides of the sidewall, wherein the first pair of mounting flanges are aligned with the second pair of mounting flanges when the first and second structural members are joined to each other.

8. The ventilating exhaust fan of claim 7 wherein the first and second structural members are formed from galvanized steel.

9. The ventilating exhaust fan of claim 1 further comprising a motor support plate supported between a pair of opposed sidewalls of the fan housing to support the motor within the fan wheel chamber, the motor support plate having a detent that contacts the fan scroll to support the motor support plate on the fan scroll, wherein the fan scroll includes a pre-load notch having a reduced height relative to the remaining portions of the fan scroll such that a motor support plate can pivot toward the pre-load notch about the detent.

10. The ventilating exhaust fan of claim 1 further comprising a first series of view holes and a second series of view holes each vertically spaced along opposite edges of one of the sidewalls of the fan housing such that the view holes can be used to align the fan housing with a support member to which the fan housing is mounted.

11. A ventilating exhaust fan, comprising:

a fan housing;

a fan within the fan housing;

a fan scroll in the fan housing, the fan located within the fan scroll, the fan scroll having a first side substantially facing the fan and a second oppositely facing side;

a removable panel coupled within the fan housing to at least one wall in the fan housing;

an electrical receptacle coupled to the removable panel and removable with the panel from the fan housing; and an electrical enclosure at least partially defining a space between the removable panel, the fan housing, and the second side of the fan scroll.

12. The ventilating exhaust fan of claim 11, wherein the at least one wall is a wall of the fan housing.

13. The ventilating exhaust fan of claim 11, further comprising a tab on the removable panel, the tab being manipulatable by a user to pull the removable panel and to de-couple and remove the removable panel from the fan housing without the use of tools.

14. The ventilating exhaust fan of claim 11, wherein the removable panel is removably coupled to two walls of the fan housing.

15. The ventilating exhaust fan of claim 11, wherein the electrical enclosure is at least partially defined by the removable panel, two fan housing walls defining a comer of the fan housing, and the fan scroll.

16. The ventilating exhaust fan of claim 11, wherein the removable panel is pivotable between a first position installed within the fan housing and a second position in which the removable panel can be removed from the fan housing.

17. The ventilating exhaust fan of claim 11, wherein the electrical receptacle is an electrical socket adapted to removably receive an electrical plug.

18. The ventilating exhaust fan of claim 11, further comprising a gap defined between the fan scroll and the removable panel permitting wiring to pass between the fan scroll and the removable panel.

19. A method of wiring a ventilating exhaust fan to power supply wire, comprising:

providing an electrical receptacle connected to a receptacle panel;

connecting at least one wire of the electrical receptacle to at least one electrical power supply wire;

inserting the receptacle panel and the electrical receptacle into a fan housing;

removably coupling the receptacle panel to at least one wall within the fan housing; and enclosing a space between the receptacle panel, a fan scroll within the fan housing, and at least one wall of the fan housing, the fan scroll separating the fan on one side of the fan scroll from the space on an opposite side of the fan scroll.

20. The method of claim 19, wherein the electrical enclosure is defined between the receptacle panel, a fan scroll, and at least two housing walls in a corner of the fan housing.

21. The method of claim 20, wherein removably coupling the receptacle panel includes pivoting the receptacle panel into an installed position in the fan housing.

22. The method as claimed in claim 19, further comprising:

de-coupling the receptacle panel from within the fan housing; and removing the receptacle panel from within the fan housing.

23. The method as claimed in claim 22, wherein de-coupling and removing the receptacle panel includes a user grasping a tab of the receptacle panel.

24. A method of mounting a ventilating exhaust fan to surrounding structure including a structural member and a wall having a thickness, the method comprising:

positioning a housing of the ventilating exhaust fan adjacent to the structural member;

coupling the housing to the structural member:

bending a resilient tab on a wall of the housing to a position out of plane with respect to the wall of the housing; and positioning the wall of the surrounding structure adjacent to the bent tab, the bent tab being located a distance from an edge of the housing wall that is substantially the same as the thickness of the wall of the surrounding structure.

25. A ventilating exhaust fan adapted for installation in a wall having at least one planar wall member with a thickness, the ventilating exhaust fan comprising:

a fan housing, the fan housing having a sidewall; and an edge defined by the sidewall;

a centrifugal fan scroll contained within the fan housing; and an exhaust outlet in the fan housing;

a tab located in the sidewall, the tab bendable to a position out of plane with respect to the sidewall, whereby the position of the tab is located a distance that is substantially the same as the thickness of the at least one planar wall member.

* * * * *